US006179241B1

(12) United States Patent
Ba Dour, Jr. et al.

(10) Patent No.: US 6,179,241 B1
(45) Date of Patent: Jan. 30, 2001

(54) CONTROL MECHANISM FOR A BEDROLL OF A REWINDER

(75) Inventors: James D. Ba Dour, Jr.; Joseph A. Blume, both of Green Bay, WI (US)

(73) Assignee: Paper Converting Machine Co., Green Bay, WI (US)

( * ) Notice: Under 35 U.S.C. 154(b), the term of this patent shall be extended for 0 days.

(21) Appl. No.: 09/354,078

(22) Filed: Jul. 15, 1999

(51) Int. Cl.[7] ..... B65H 19/26
(52) U.S. Cl. ..... 242/527.1
(58) Field of Search ..... 242/527.1, 527, 242/527.2, 527.3, 527.4, 533.4, 533.5, 533.6

(56) References Cited

U.S. PATENT DOCUMENTS

| | | | | |
|---|---|---|---|---|
| Re. 28,353 | | 3/1975 | Nystrand et al. . | |
| 3,128,057 | * | 4/1964 | Barnhart et al. | 242/527.1 |
| 3,505,150 | * | 4/1970 | Andersson | 242/527.1 |
| 3,549,097 | * | 12/1970 | Seigh | 242/527.1 |
| 3,997,387 | * | 12/1976 | Yamaguchi et al. | 242/527.1 |
| 4,280,669 | * | 7/1981 | Leanna et al. | 242/527.1 |
| 4,723,724 | | 2/1988 | Bradley . | |
| 4,909,492 | | 3/1990 | Biagotti . | |
| 5,104,055 | | 4/1992 | Buxton . | |

* cited by examiner

*Primary Examiner*—John M. Jillions

(57) ABSTRACT

The invention provides a new latch mechanism which is controlled by a camshaft which is mounted axially in the bedroll and by a servo motor which rotates the camshaft. The servo motor normally rotates the camshaft in the same direction and at the same speed as the bedroll. When the web is to be severed, the speed of the servo motor is either increased or decreased to rotate the camshaft relative to the bedroll. The rotation of the camshaft allows push rods in the bedroll to move radially inwardly to release the severing and transferring mechanism. Cam followers for the severing and transferring mechanism engage a stationary cam and control the movement of the mechanism. After the web is severed and transferred, the camshaft is rotated to force the push rods radially outwardly to relatch the severing and transferring mechanism.

16 Claims, 8 Drawing Sheets

CONTROL MECHANISM FOR A BEDROLL OF A REWINDER

BACKGROUND

This invention relates to a control mechanism for a bedroll of a rewinder.

Rewinders are used to convert large parent rolls of paper into retail sized rolls of bathroom tissue and paper towels. Two types of rewinders are commonly used—center rewinders and surface rewinders. Center rewinders are described, for example, in U. S. Reissue Pat. No. 28,353 and wind the web on a core which is rotated by a mandrel. Surface rewinders are described, for example, in U. S. Pat. Nos. 4,723,724 and 5,104,055 and wind the web on a core which is rotated by a three roll cradle.

The critical operation in both center rewinders and surface rewinders is the sequence of steps referred to as cutoff and transfer. The web must be severed to end the winding of one roll, the leading edge of the severed web must be transferred to a new core, and the new core must be rotated to begin winding a new roll. These steps must be accomplished repeatedly and reliably while the web is moving at high speed. It is also desirable that each roll have exact sheet count and that the web is wound uniformly and substantially without wrinkles.

The term "bedroll" refers to the main winding roll of a rewinder, either a center rewinder or a surface rewinder.

As described in U.S. Reissue Pat. No. 28,353, a bedroll is commonly used in conjunction with a chopper roll to sever the web after a predetermined length has been wound into a log and to transfer the leading edge of the severed web to a new core in a continuous winding process. In all current center rewinders a latch mechanism is used to retain the severing and transferring mechanism in an inoperative position until the proper length of web has been wound onto the log. A cam follower is controlled by an electric solenoid or pneumatic cylinder to unlatch the latch mechanism to release the severing and transferring mechanism. The severing and transferring mechanism is then controlled by one or more cams to perform the cutoff and transfer operations on the web. The latch is thereafter reset by the cam to retain the severing and transferring mechanism in the inoperative position.

A conventional latch mechanism and a severing and transferring mechanism for center rewinders is described in detail in U.S. Reissue Pat. No. 28,353. The severing and transfer mechanism includes pins 56, cutoff blades 58 and 59, and transfer pads 55, all of which are movably mounted in the bedroll. When the severing and transfer mechanism is unlatched, the pins 56 hold the web against the rotating bedroll while the web is severed by a chopper roll 49 and the blades 58 and 59 (see FIGS. 20 and 21). The transfer pads thereafter urge the leading end of the severed web against a new core 53 (FIGS. 22 and 23).

Surface rewinders sold by Paper Converting Machine Company of Green Bay, Wis. under the name "Magnum" include similar movable pins in a bedroll for holding the severed web against the bedroll and a similar latch mechanism for retaining the pins in an inoperative position until the web is to be severed. A cutoff knife is movably mounted in a chopper roll and is retained in an inoperative position by a latch mechanism which is similar to the latch mechanism which is used on the bedroll of a center rewinder.

One of the problems with the prior art severing and transfer mechanism is a limitation on the speed at which the solenoid can position the cam follower to release the latch mechanism. Another problem results from the impact loads on the components of the mechanism which cause fatigue failures and frequent maintenance. The mechanisms may also cause excessive vibration in the rewinder which can adversely affect other functions of the rewinder such as perforating the web.

SUMMARY OF THE INVENTION

The invention provides a new latch mechanism which is controlled by a camshaft which is mounted axially in the bedroll and by a servo motor which rotates the camshaft. The servo motor normally rotates the camshaft in the same direction and at the same speed as the bedroll. When the web is to be severed, the speed of the servo motor is either increased or decreased to rotate the camshaft relative to the bedroll. The rotation of the camshaft allows push rods in the bedroll to move radially inwardly to release the severing and transferring mechanism. Cam followers for the severing and transferring mechanism engage a stationary cam and control the movement of the mechanism. After the web is severed and transferred, the camshaft is rotated to force the push rods radially outwardly to relatch the severing and transferring mechanism.

The invention enables two severing and transferring mechanisms to be included in the bedroll and to be independently controlled based on the direction of rotation of the camshaft relative to the bedroll. Such a bedroll can have a larger diameter than conventional bedrolls without adversely affecting the flexibility of providing wound rolls with different sheet counts. The larger bedroll is stiffer and rotates at a slower angular velocity for an equivalent web speed.

DESCRIPTION OF THE DRAWING

The invention will be explained in conjunction with an illustrative embodiment which is shown in the accompanying drawing, in which.

DESCRIPTION OF SPECIFIC EMBODIMENT

Figure 1:
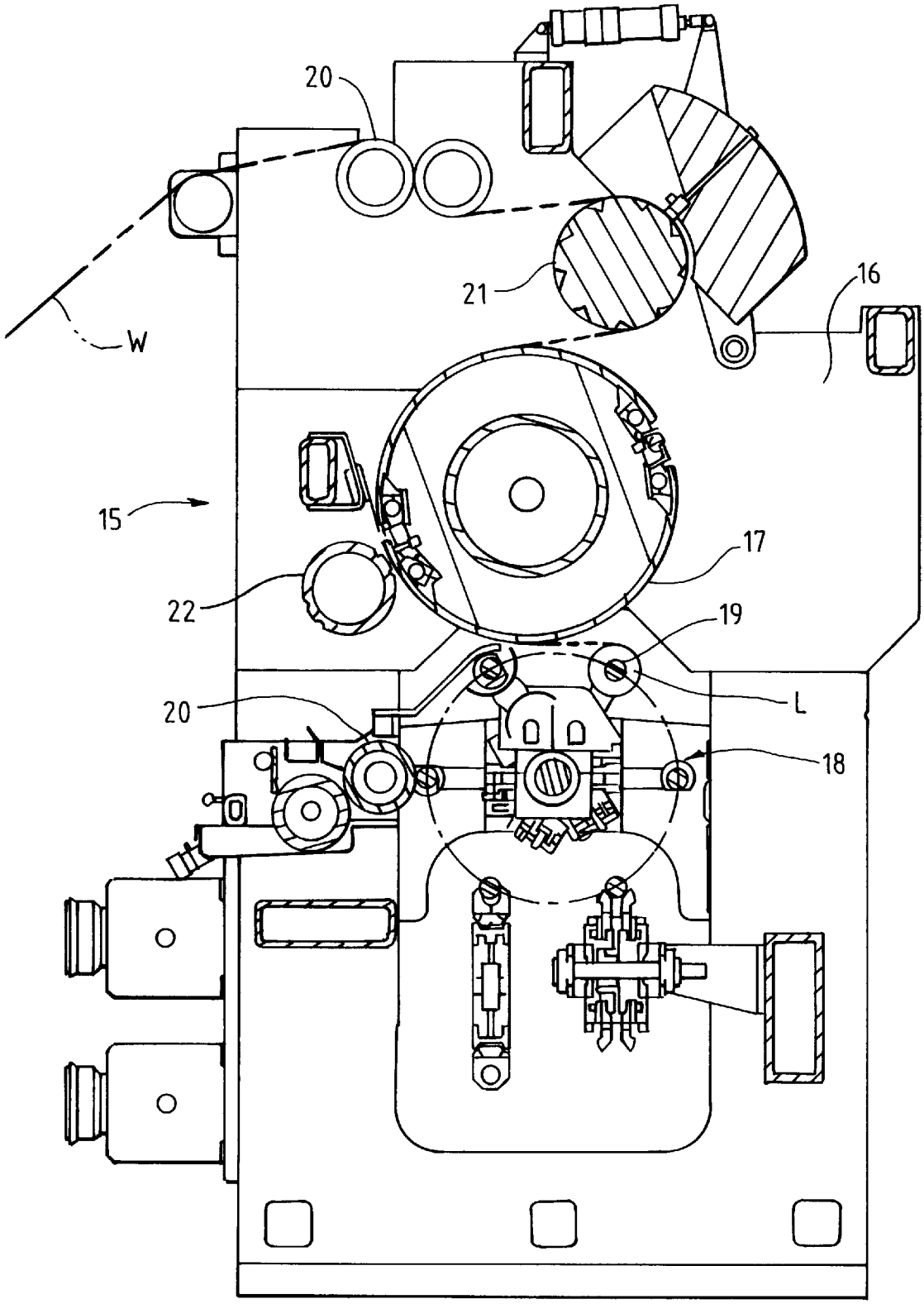
FIG. 1 illustrates a center rewinder which is equipped with a control mechanism in accordance with the invention.

The invention will be explained in conjunction with a center rewinder 15 illustrated in FIG. 1. However, it will be understood that the invention can also be used with surface rewinders.

The rewinder 15 includes a frame 16 and a bedroll 17 which is rotatably mounted in the frame. A turret assembly 18 is rotatably mounted in the frame below the bedroll. As is well known in the art, the turret assembly includes a plurality of rotating mandrels 19 on which paperboard cores are mounted. An adhesive applying apparatus 20 applies transfer adhesive to a new core before each winding cycle.

A web W is advanced by draw rolls 20 through a perforator 21 to the bedroll 17. The perforator forms longitudinally spaced transverse lines of perforation in the web.

The surface speed of the bedroll matches the speed of the web, and the bedroll delivers the web to a log L which is being wound on the mandrel at about the 5:00 o'clock position of the bedroll. When the proper length of web has been wound on the log, the web will be severed by a chopper roll 22 and a new winding cycle will begin.

Figure 2:
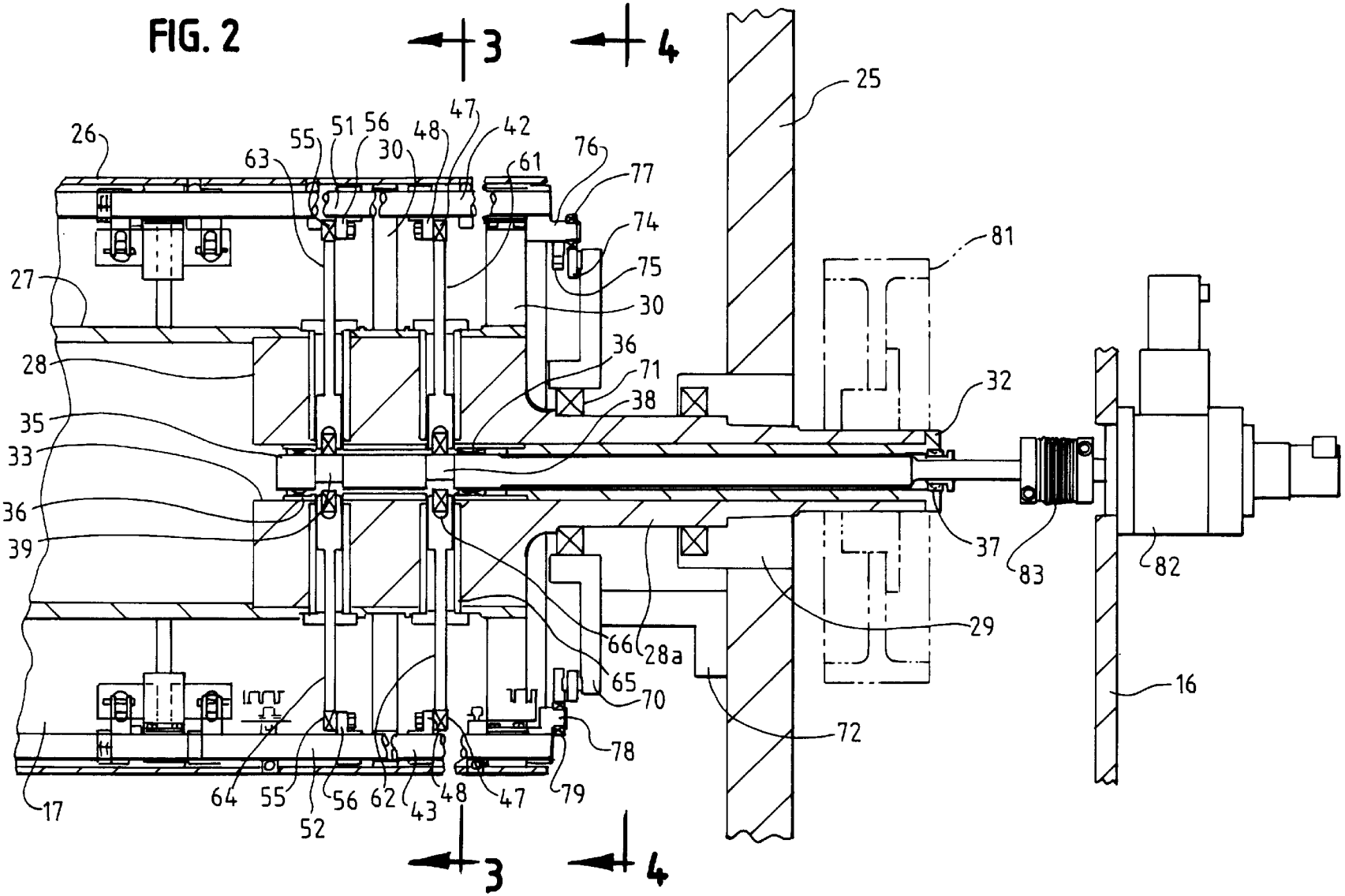
FIG. 2 is fragmentary longitudinal sectional view through the bedroll of the rewinder.

Referring now to FIG. 2, the frame of the rewinder includes a pair of side frames 25 which rotatably support the bedroll 17. The bedroll includes an outer cylindrical shell 26, a central tube 27, and a pair of journal and headers 28 which are mounted in each end of the tube 27. The journal portion 28*a* of the journal and header is rotatably mounted in a bearing 29 in the frame 25. The outer shell 26 is supported by radial spacers 30 which extend outwardly from the central tube 27.

A camshaft sleeve 32 is mounted within an axially extending bore 33 in the journal and header 28. A camshaft 35 is rotatably mounted within the camshaft sleeve by bearings 36 and 37. The portions of the camshaft which are supported by the bearings are cylindrical, and the camshaft includes a pair of cam portions 38 and 39.

A pair of transfer pin pivot shafts 42 and 43 (see also FIGS. 3 and 4) are rotatably supported by the radial spacers 30 and extend along the length of the bedroll. A plurality of transfer pins 44 (FIGS. 3 and 4) are clamped to each of the transfer pin pivot shafts 42 and 43 by clamps 45. The transfer pins are spaced-apart axially along the length of the bedroll. A cam follower or roller 47 is rotatably mounted adjacent each end of each of the transfer pin pivot shafts 42 and 43 by a clamp 48.

Figure 3:
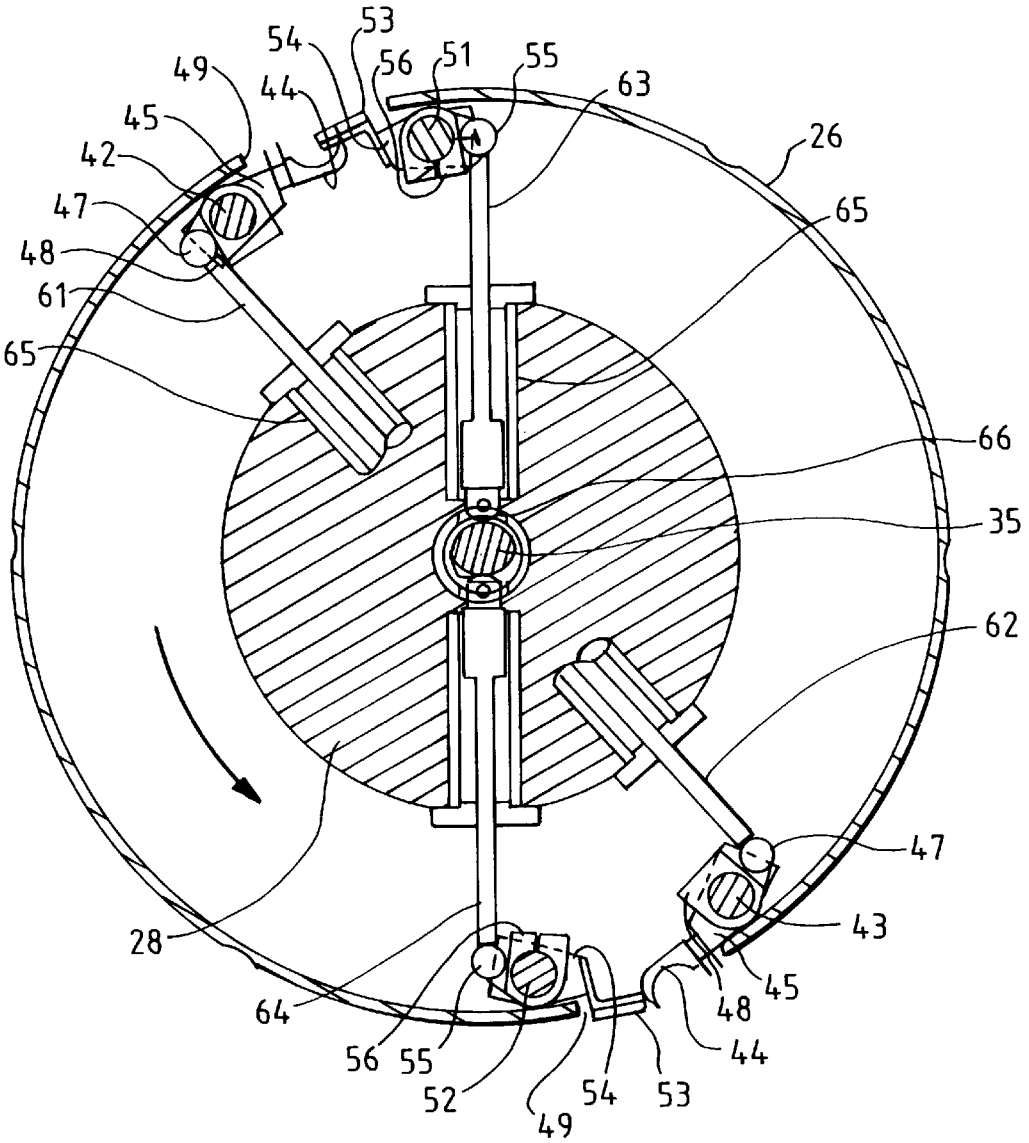
FIG. 3 is a transverse sectional view of the bedroll taken along the line 3—3 of FIG. 2 which illustrates one of the severing and transferring mechanisms in a latched position and the other severing and transferring mechanism in an unlatched position.

Referring to FIG. 3, the transfer pin pivot shafts 42 and 43 are located 180° apart around the circumference of the bedroll. Usually only one of the transfer pivot shafts will be operated during the winding operation. The outer shell 26 of the bedroll is provided with openings 49 through which the transfer pins 44 can pivot outwardly as will be explained hereinafter.

A pair of transfer pad pivot shafts 51 and 52 (FIGS. 2 and 3) are also rotatably supported by the radial spacers 30. A plurality of axially spaced transfer pads 53 are clamped to each of the transfer pad pivot shafts 51 and 52 by clamps 54. A cam follower or roller 55 is rotatably mounted adjacent each end of each of the transfer pad pivot shafts by a clamp 56 (FIG. 3). The two transfer pad pivot shafts are located 180° apart on the bedroll. Each transfer pad 53 is located slightly upstream of its associated transfer pin 44 along the circumference of the bedroll. The bedroll rotates counterclockwise in FIG. 3 as indicated by the arrow.

Four push rods 61, 62, 63, and 64 are reciprocably mounted in radially extending bores 65 in the journal and header 28. The push rods 61 and 62 operate to maintain the two transfer pin pivot shafts 42 and 43 in their latched positions, and the push rods 63 and 64 operate to maintain the transfer pad pivot shafts 51 and 52 in their latched positions. A cam follower 66 is rotatably mounted on the inner end of each of the push rods. The cam follower on each of the push rods 61 and 62 is engageable with the cam portion 38 of the central camshaft 35. (See FIG. 2) The cam follower on each of the push rods 63 and 64 is engageable with the cam portion 39 of the central camshaft 35. The outer end of each of the pivot rods 61 and 62 is engageable with one of the cam followers 47 of the transfer pin clamps 45. The outer end of each of the push rods 63 and 64 is engageable with one of the cam followers 55 of the transfer pad clamps 54.

Figure 8:
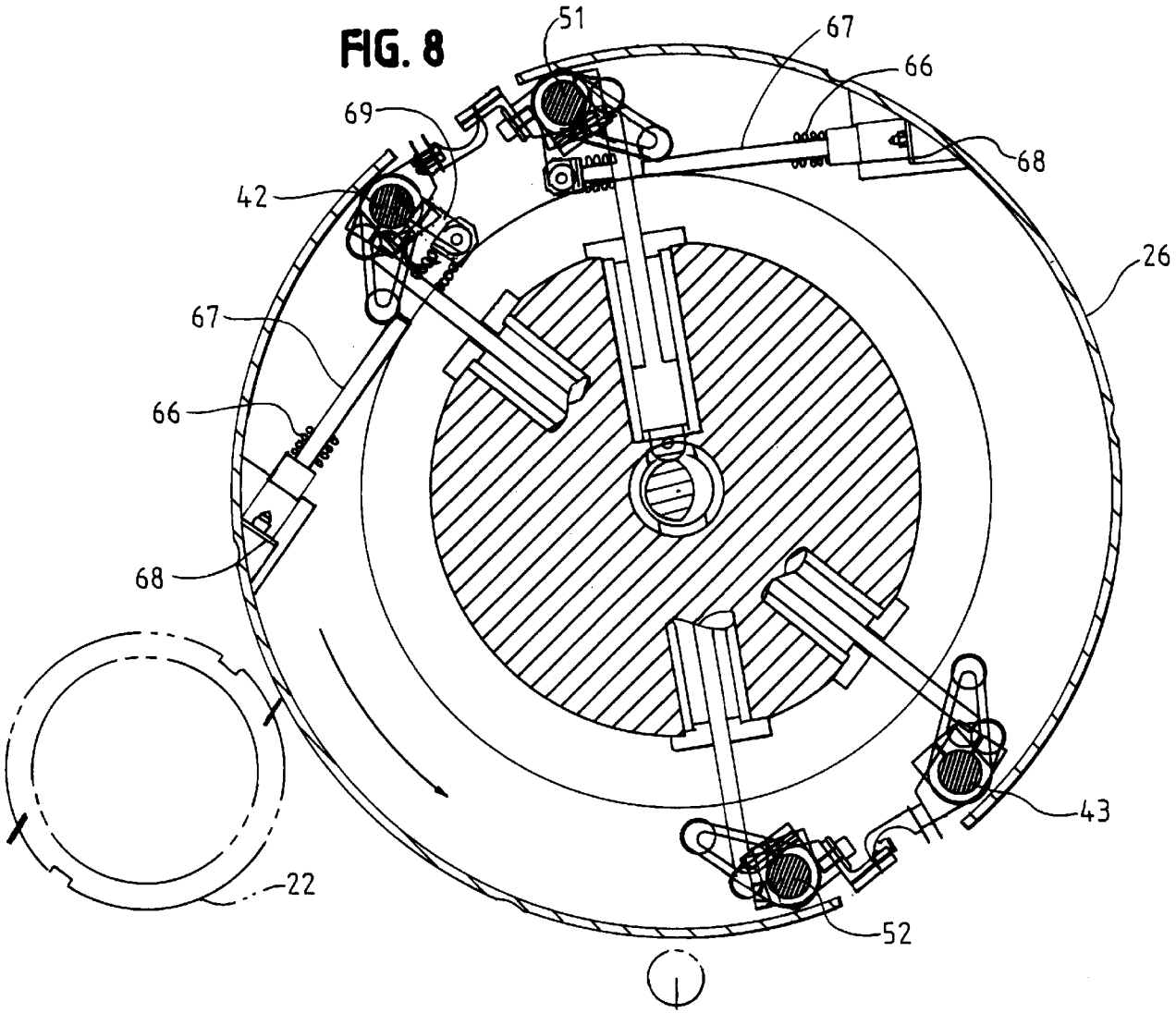
FIG. 8 illustrates the springs for maintaining the severing and transferring mechanisms in contact with the push rods in the latched position.

Each of the transfer pin pivot shafts 42 and 43 is spring-loaded to rotate counterclockwise as viewed in FIG. 3 to urge the cam followers 47 against the outer ends of the push rods 61 and 62. Referring to FIG. 8, a compression spring 66 is slidably mounted on a rod 67. The outer end of the rod is secured to a bracket 68 on the inside surface of the outer shell 26 of the bedroll. The inner end of the spring is attached to a lever arm 69 which extends from each of the pivot shafts 42 and 43.

Each of the transfer pad pivot shafts 51 and 52 is similarly spring-loaded to rotate clockwise as viewed in FIG. 3 to urge the cam followers 55 against the outer ends of the push rods 63 and 64.

Referring to FIG. 2, a transfer cam bracket 70 at the right end of the bedroll is rotatably mounted on the journal 28*a* by a bearing 71. The cam bracket is held stationary as the journal rotates by a bracket spacer 72 which is secured to the bracket and to the frame 25.

A stationary circular or ring transfer pin cam 74 is mounted on the inside face of the cam bracket 70, and a stationary transfer pad cam 75 is mounted on the cam bracket inside of the transfer pin cam 74. A transfer pin cam follower arm 76 is mounted on each end of the transfer pin pivot shafts 42 and 43. A cam follower bearing 77 is rotatably mounted on each of the cam follower arms 76. A transfer pad cam follower arm 78 is mounted on each end of the transfer pad pivot shafts 51 and 52. A cam follower bearing 79 is rotatably mounted on each of the cam follower arms 78.

The bedroll 17 is rotated by a gear 81 (FIG. 2) which is secured to the end of the bedroll journal 28*a*. The gear 81 is driven by the servo drive system of the rewinder which is conventional and well known.

The camshaft 35 is rotated by a servo motor 82 which is mounted on the frame 16. The camshaft is connected to the servo motor by a coupler 83.

Operation

During the winding operation the surface speed of the bedroll is the same as the speed at which the web is advanced through the rewinder as shown in FIG. 1. The web wraps a portion of the bedroll and rotates with the bedroll toward the winding log L. The servo motors 82 which rotate the central camshafts 35 at each end of the bedroll rotate the camshafts at the same speed as the bedroll so that there is no relative rotation between the camshafts and the bedroll. The drive system for the bedroll and the servo motors 82 can all be controlled by the same processor, for example, a PIC 900 manufactured by Giddings & Lewis.

Figure 4:
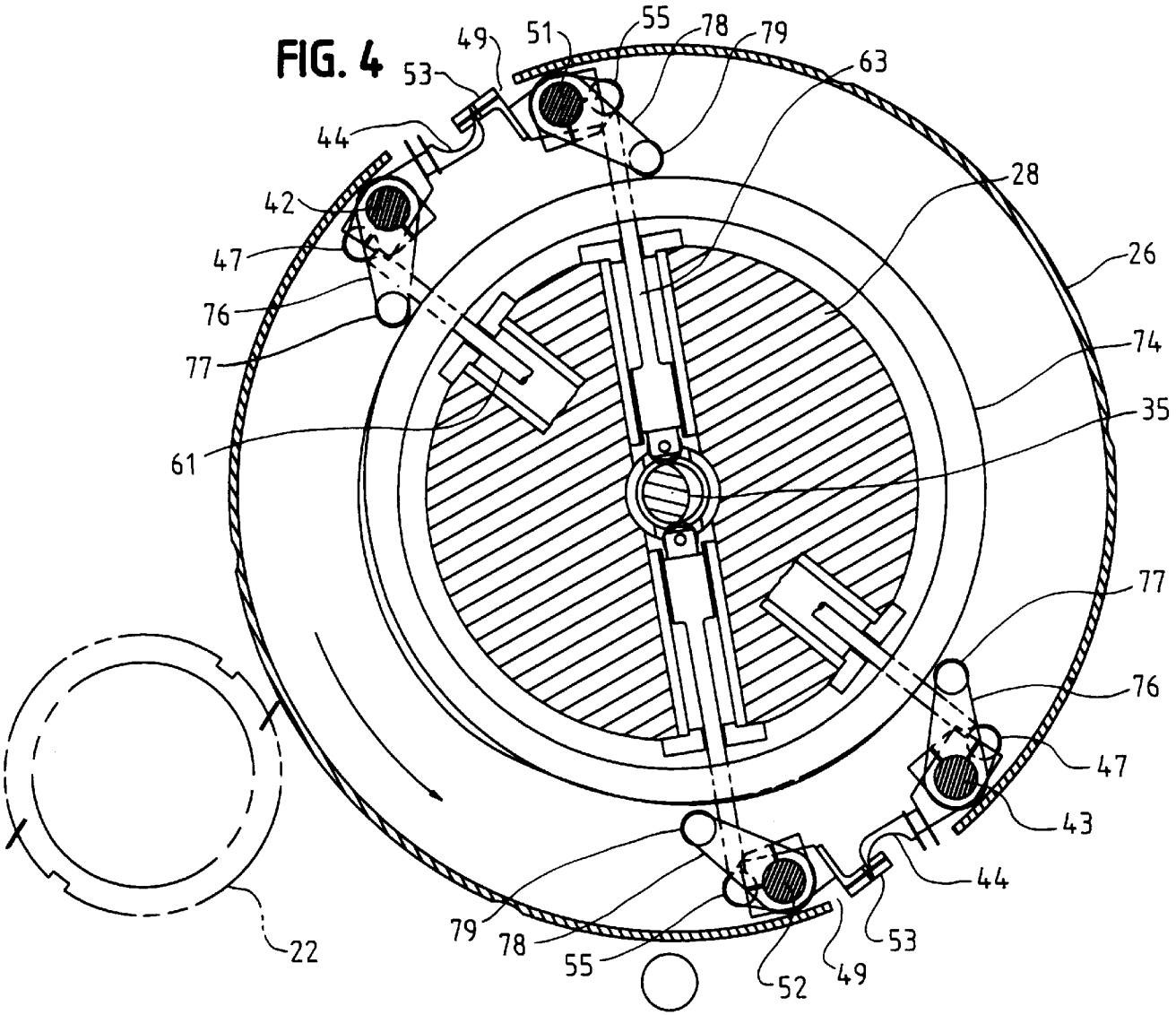
FIG. 4 is a transverse sectional view taken along the line 4—4 of FIG. 2 showing both of the severing and transferring mechanisms in a latched position.

The push rods 61–64 are normally maintained by the central camshaft 35 in their outer or latching positions as illustrated in FIG. 4. The push rods 61–64 engage the rollers 47 and 55 and maintain the pivot shafts 42, 43, 51, and 52 and the transfer pins 44 and transfer pads 53 in their latched positions in which the pins 44 and pads 53 are radially inward of the outer surface of the bedroll.

During the revolution of the bedroll in which the web will be severed, the servo motors 82 either increase or decrease the rotational speed of the camshafts 35 so that the cams 38 and 39 rotate relative to the push rods 61–64. The profile of each of the cams preferably includes a dwell portion of about 180° which has a substantially constant diameter and a reduced diameter recessed portion. As the log is being wound, the cam followers of all of the push rods engage the dwell portion of the cams and are thereby retained in their latching positions illustrated in FIG. 4. When the cam 38 is rotated about 90°, only one of the push rods 61 and 62 will engage the recessed portion of the cam. The other push rod will engage the dwell portion of the cam and be retained in its latching position. Similarly, when the cam 39 is rotated about 90°, only one of the push rods 63 and 64 will engage the recessed portion of the cam. The other push rod will engage the dwell portion of the cam and be retained in its latching position.

Figure 5:
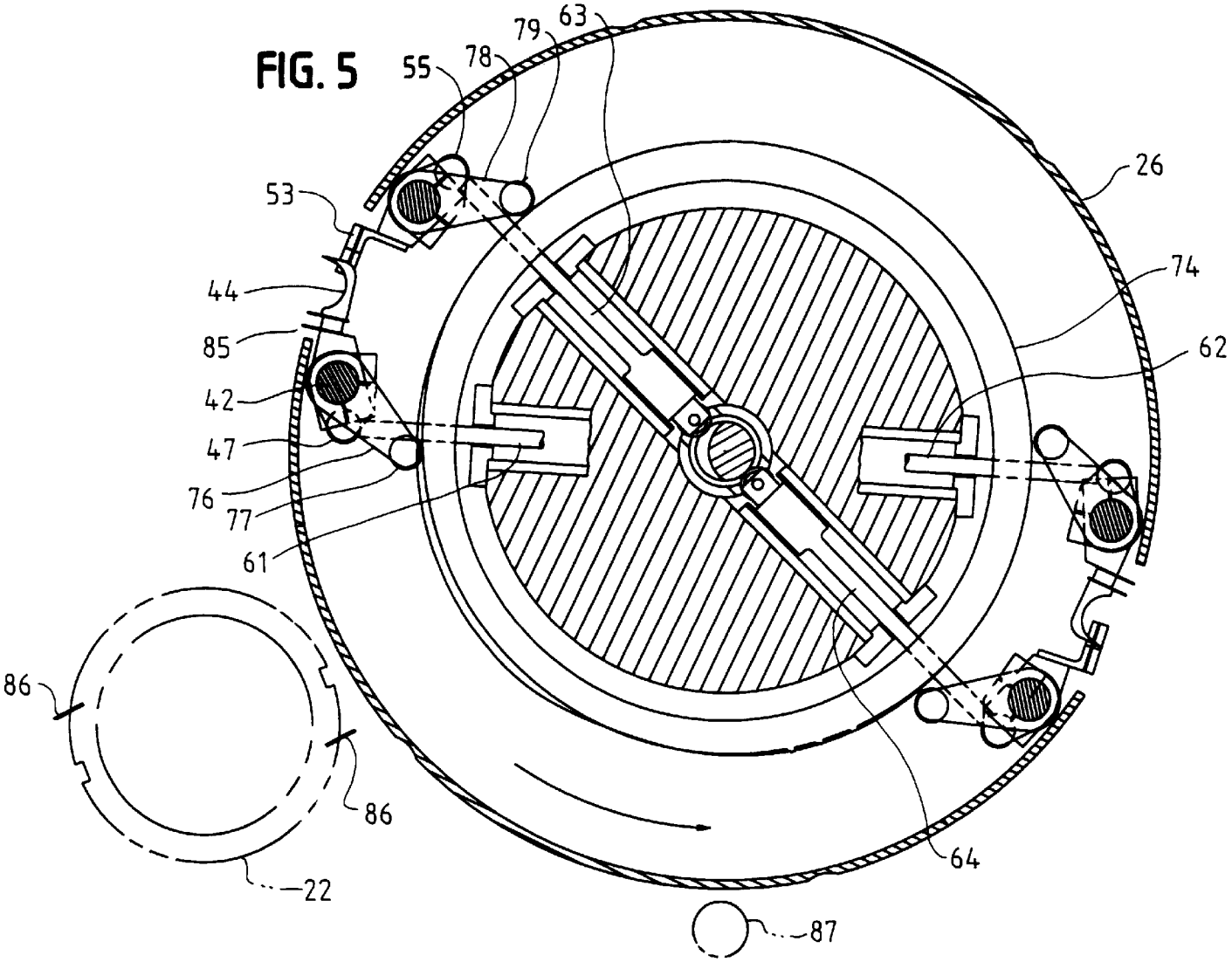
FIG. 5 is a view similar to FIG. 4 showing the severing and transferring mechanism at the 10:00 o'clock position unlatched as it rotates toward the chopper roll.

Referring to FIG. 5, cams 38 and 39 have been rotated so that the push rods 61 and 63 engage the recessed portions of the cams. As the push rods move from the dwell portions of the cams to the recessed portions, the push rods are allowed to move radially inwardly from their latching position. The push rods are forced inwardly by the springs 66 (FIG. 8) and by the centripetal forces on the transfer pins and the transfer pads which urge the pins and pads to move radially outwardly through the openings 49 in the bedroll. As the transfer pins 44 and the transfer pin pivot shaft 42 pivot counterclockwise to the unlatched position shown in FIG. 5, the cam follower arm 76 also pivots counterclockwise until the cam follower bearing 77 engages the stationary transfer pin cam 74. Thereafter, movement of the pivot shaft 42 and the transfer pins 44 is controlled by the cam 74.

Similarly, inward movement of the push rod 63 permits the transfer pads 53 and the transfer pad pivot shaft 51 to rotate clockwise until the bearing 79 on the cam follower arm 78 engages the stationary transfer pad cam 75 (see the right hand portion of FIG. 2). Movement of the transfer pads is thereafter controlled by the cam 75.

The operation of the transfer pins 44 and the transfer pads 53 is similar to the operation of the transfer pins and transfer pads which is described in U.S. Reissue Pat. No. 28,353 and will be apparent to those skilled in the rewinder art. Only a brief description of the operation is necessary. Also, the web is omitted from FIGS. 4–7 for clarity of illustration.

In FIG. 5 the transfer pins at 10:00 o'clock are unlatched, and the contour of the stationary cam 74 allows the pivot shaft 42 to rotate counterclockwise so that the transfer pins 44 extend radially beyond the outer surface of the bedroll so that the pins impale the web (not shown) which wraps a portion of the outer surface of the bedroll. A pair of spaced cutoff blades 85 are mounted on each of the transfer pins, and the cutoff blades also project beyond the surface of the bedroll. The contour of the stationary cam 75 is such that at 10:00 o'clock the transfer pads 53 are substantially flush with the surface of the bedroll.

Figure 6:
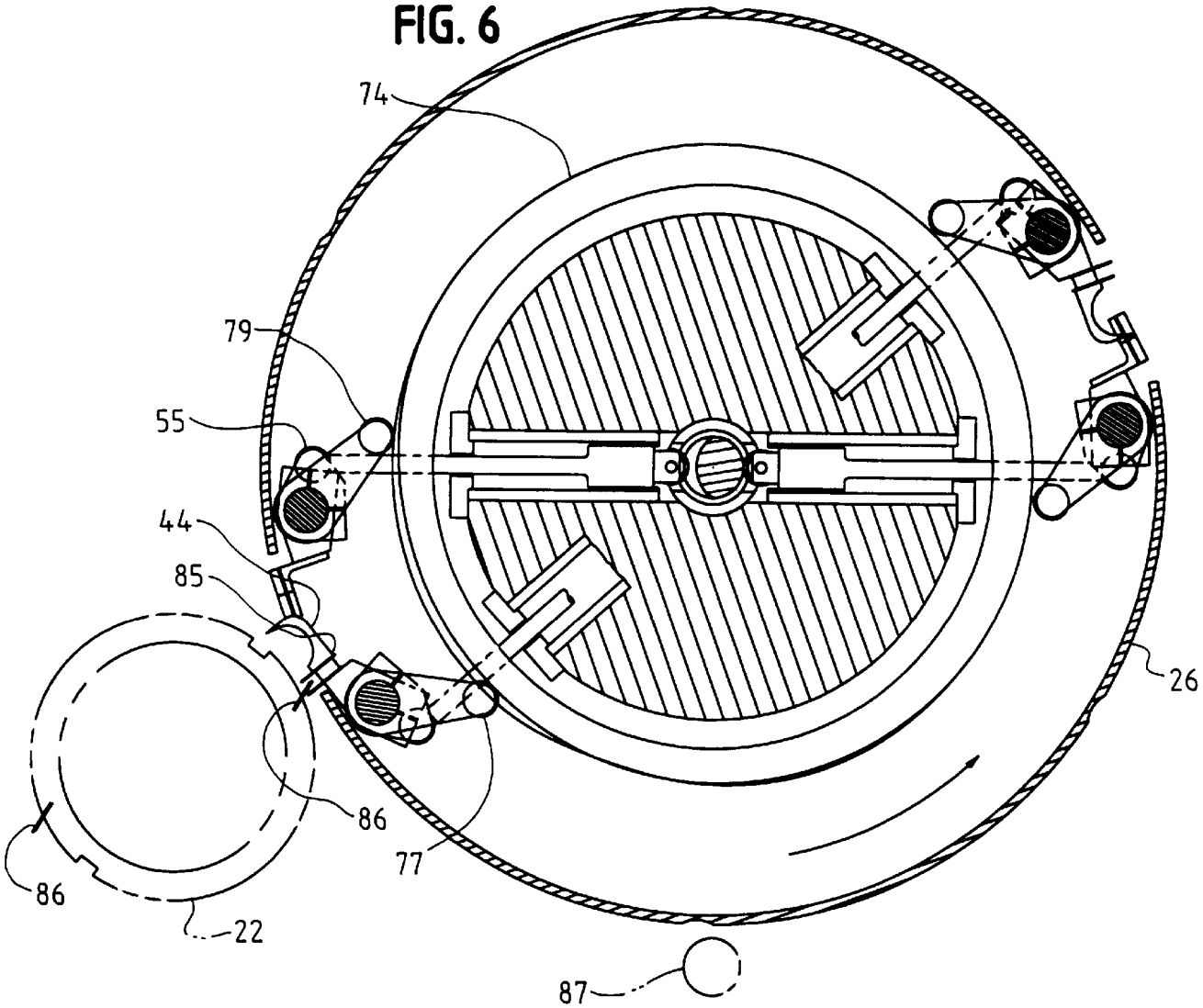
FIG. 6 is a view similar to FIG. 5 showing the unlatched severing and transferring mechanism cooperating with a chopper roll to sever the web, the web being omitted for clarity of illustration.

FIG. 6 illustrates the cutoff of the web. The speed of the rotating chopper roll 22 is timed so that one of the cutoff knives 86 on the chopper roll enters the space between the cutoff blades 85 to sever the web. After the web is severed, the leading end portion of the web is held on the rotating bedroll by the transfer pins 44. As described in U. S. Reissue Pat. No. 28,353, the portion of the web between the severed leading edge and the transfer pins may fold back as the bedroll rotates.

Figure 7:
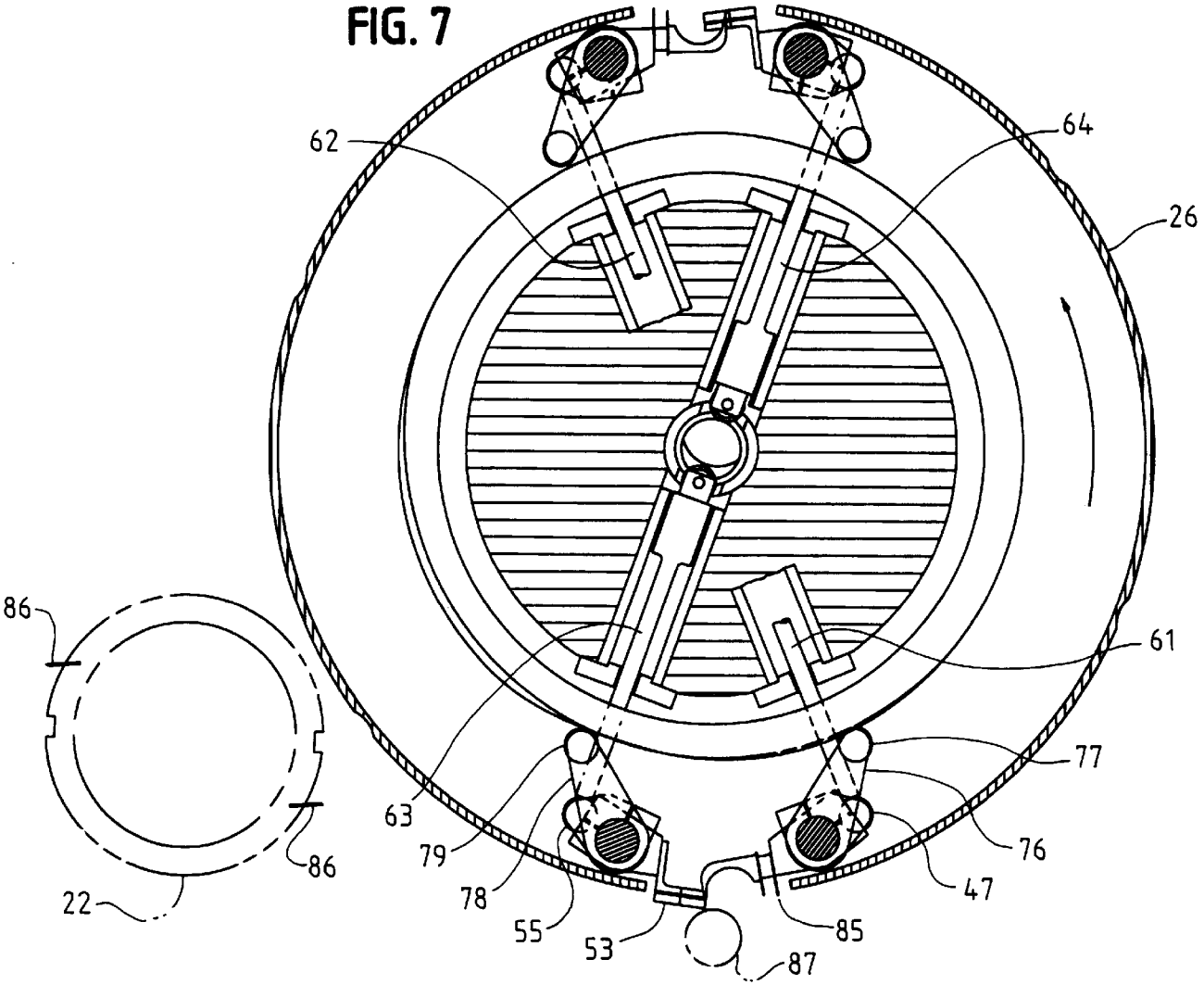
FIG. 7 is a view similar to FIG. 6 showing the transfer pad at the 6:00 o'clock position transferring the leading end of the severed web to a new core, the web being omitted for clarity of illustration.

FIG. 7 illustrates the transfer of the leading end of the web to a new core 87. The core is mounted on a mandrel which rotates the core clockwise. As the bedroll moves from its FIG. 6 position to its FIG. 7 position, the stationary transfer pin cam 74 causes the transfer pins to rotate clockwise so that the pins are positioned radially inwardly of the new core at transfer. The stationary transfer pad cam 75 causes the transfer pads to pivot clockwise so that the transfer pads push the web onto the new core 87. The new core is provided with conventional rings or stripes of transfer adhesive so that the web is transferred to the new core.

After the web is transferred, the servo motors 82 rotate the camshafts 35 to force the push rods 61 and 63 radially outwardly against the cam followers 47 and 55 to pivot the transfer pins 44 and the transfer pads 53 back to their latched positions. The transfer pins and transfer pads are retained in their latched positions until the next cutoff cycle. The servo control method which uses a single control axis aligned with the axis of the bedroll permits the bedroll to have two severing and transferring mechanisms located 180° apart. The two severing and transfer mechanisms can be independently controlled based on the direction of rotation of the camshafts 35 relative to the bedroll. This feature allows the rewinder to produce logs in smaller increments of length than is possible with a single mechanism bedroll. Typical tissue products are produced in multiples of ten sheets. For example, rolls of bathroom tissue may be provided in sheet counts of 280, 290, 300, etc. A sheet is the distance between lines of perforation.

In the United States, bathroom tissue traditionally has had perforations spaced 4.5 inches apart. A typical bedroll for bathroom tissue has a nominal circumference of ten 4.5 inch sheets or 45 inches. However, current market trends are for shorter sheet lengths, for example, 4 inches. A bedroll having a single severing and transferring mechanism would need to have a 40 inch circumference to produce products in ten sheet multiples. The reduced circumference results in a bedroll with less stiffness which rotates at a higher rotational speed for an equivalent web speed. The higher rotational speed increases the centrifugal forces which act on the bedroll and the severing and transferring mechanisms. The reduction in stiffness of the bedroll and the increased centrifugal loading increases vibration, reduces liability, and reduces the maximum web speed at which the bedroll can operate.

By providing a bedroll with two severing and transferring mechanisms which are located 180° apart, the circumference of the bedroll can be 80 inches and still produce products with 4 inch sheet length in multiples of ten sheets. The structure of the 80 inch circumference bedroll is stiffer than a 40 inch bedroll, and the 80 inch bedroll operates at lower rotational speeds with lower centrifugal forces. The increase in stiffness of the bedroll and the reduction in centrifugal loading allows for reliable operation at higher web speeds and/or greater web widths.

Although the preferred embodiment of the invention provides a bedroll with two severing and transferring mechanisms located 180° apart, a bedroll could also be provided with a single severing and transferring mechanism. Such a bedroll would have only two push rods rather than the four push rods which have been described.

Also, the preferred rotary drives for the camshafts 35 are servo motors. However, any equivalent rotary drive system can be used as long as the speed of the camshafts can be synchronized with the speed of the bedroll during the winding operation so that the push rods are maintained in their latching positions.

In the winding operation which has been described, the web is wound on cardboard cores. However, the web could also be wound on recycled mandrels which are removed from the log after the log is wound as described in U.S. Pat. No. 5,421,536.

Mounting the stationary ring cams 74 and 75 on the journal 28*a* rather than on the frame of the rewinder permits the cams to be more precisely positioned relative to the axis of the bedroll. The more accurate positioning of the cams 74 and 75 allows the spacing between the cams and the cam followers 77 and 79 to be reduced when the cam followers are in their latched positions, and thereby reduces the amount of travel of the cam followers when they are unlatched. For example, in one embodiment of the invention, the cam followers 77 and 79 are spaced only about 0.005 inch from the cams 74 and 75 when the cam followers are latched. When the central cam 35 unlatches the cam followers, the cam followers drop only about 0.005 inch before they contact the stationary cams 74 and 75.

Although we have described the outward movement of the push rods 61–64 as causing relatching of the severing and transferring mechanism, the mechanisms could be constructed so that the push rods are cammed outwardly to unlatch the severing and transferring mechanism.

Each of the pivot shafts 42, 43, 51, 52 and their associated rollers, cam followers, and transfer pins or transfer pads is a web-engaging assembly. The web-engaging assemblies are normally latched so that they do not engage the web during winding. During the cutoff and transfer cycle, two cooperating web-engaging assemblies which include transfer pins 44 and transfer pads 53 are unlatched so that the pins can hold the web during cutoff and the pads can push the leading end of the severed web onto the new core.

In the current preferred embodiment, the movement of the transfer pins and transfer pads are controlled by the stationary cams 74 and 75 immediately after the pins and pads are unlatched. However, if desired, the stationary cams could be omitted, and the movement of the transfer pins and transfer pads could be controlled by the push rods 61–64 and the contour of the cam portions 38 and 39 of the central camshaft 35. The central camshaft would be rotated relative to the bedroll by the servo motor 82 to move the push rods and the transfer pins and transfer pads during the cutoff and transfer cycle.

While in the foregoing specification a detailed description of specific embodiments of the invention has been set forth for the purpose of illustration, it will be understood that many of the details hereingiven can be varied considerably by those skilled in the art without departing from the spirit and scope of the invention.

We claim:

1. A web-winding apparatus comprising:

a frame, a winding roll rotatably supported on the frame for rotation about a longitudinal axis, the winding roll having an outer surface for contacting a web, a camshaft mounted in the winding roll along the axis thereof, means for rotating the camshaft at a first speed which matches the speed of the winding roll and at a second speed which is different from the speed of the winding roll, a push rod reciprocably mounted in the winding roll for reciprocating movement inwardly and outwardly along an axis which extends perpendicularly to the camshaft, the push rod having an inner end which is engageable with the camshaft and an outer end, the push rod being movable between first and second positions by the camshaft, a web-engaging assembly movably mounted on the winding roll adjacent the outer end of the push rod and including a web-engaging member, the web-engaging member being movable between a first position in which the web-engaging member is inwardly of the outer surface of the winding roll and a second position in which the web-engaging member projects beyond the outer surface of the winding roll and is engageable with a web thereon, the push rod engaging the web-engaging assembly when the push rod is in its first position to retain the web-engaging member in its first position, the push rod being movable by the camshaft when the speed of the camshaft changes between said first and second speeds so that the push rod moves away from its first position and allows the web-engaging assembly to move to its second position.

2. The apparatus of claim 1 in which the web-engaging member includes pins for piercing the web.

3. The apparatus of claim 1 in which the web-engaging member includes blades for severing the web.

4. The apparatus of claim 1 in which the web-engaging member includes pads for pushing the web away from the outer surface of the winding roll.

5. The apparatus of claim 1 in which the camshaft is shaped to allow the push rod to move inwardly as the speed of the camshaft changes from the first speed to the second speed.

6. The apparatus of claim 5 in which the camshaft is shaped to move the push rod outwardly as the speed of the camshaft changes from the second speed to the first speed.

7. The apparatus of claim 1 including a spring for resiliently biasing the web-engaging member toward its second position.

8. The apparatus of claim 1 in which the web-engaging apparatus includes a pivot shaft pivotally mounted in the winding roll, the web-engaging member being mounted on the pivot shaft, a stationary ring cam attached to the frame, and a cam follower mounted on the pivot shaft, the cam follower being movable into engagement with the ring cam when the push rod moves away from its first position.

9. The apparatus of claim 8 including a journal supporting the winding roll and rotatably mounted on the frame, the stationary ring cam being rotatably mounted on the journal whereby the position of the ring cam relative to the cam followers is controlled.

10. The apparatus of claim 1 in which the means for rotating the camshaft includes a servo motor.

11. The apparatus of claim 1 including a journal supporting the winding roll and rotatably mounted on the frame, the camshaft being rotatably mounted in the journal.

12. The apparatus of claim 1 including a second push rod reciprocably mounted in the winding roll about 180° from the first push rod and having an inner end which is engageable with the camshaft, the second push rod being movable between first and second positions by the camshaft, a second web-engaging assembly movably mounted on the winding roll about 180° from the first web-engaging assembly, the second web-engaging assembly being movable between first and second positions, the second push rod engaging the second web-engaging assembly when the second push rod is in its first position to retain the second web-engaging assembly in its first position, the second push rod being movable by the camshaft so that the second push rod moves away from its first position and allows the second web-engaging assembly to move to its second position.

13. A web-winding apparatus comprising:

a frame, a winding roll rotatably supported on the frame for rotation about a longitudinal axis, the winding roll having an outer surface for contacting a web, a camshaft mounted in the winding roll along the axis thereof, means for rotating the camshaft at a first speed which matches the speed of the winding roll and at a second speed which is different from the speed of the winding roll, a first push rod reciprocably mounted in the winding roll for reciprocating movement inwardly and outwardly along an axis which extends perpendicularly to the camshaft, the first push rod having an inner end which is engageable with the camshaft and an outer end, the first push rod being movable between first and second positions by the camshaft, a transfer pin assembly movably mounted on the winding roll adjacent the outer end of the first push rod and including a transfer pin, the transfer pin assembly being movable between a first position in which the transfer pin is inwardly of the outer surface of the winding roll and a second position in which the transfer pin projects beyond the outer surface of the winding roll and is engageable with a web thereon, the first push rod engaging the transfer pin assembly when the first push rod is in its first position to retain the transfer pin assembly in its first position, the first push rod being movable by the camshaft when the speed of the camshaft changes between said first and second speeds so that the first push rod moves away from its first position and allows the transfer pin assembly to move to its second position, a second push rod reciprocably mounted in the winding roll for reciprocating movement inwardly and outwardly along an axis which extends perpendicularly to the camshaft, the second push rod having an inner end which is engageable with the camshaft and an outer end, the second push rod being movable between first and second positions by the camshaft, a transfer pad assembly movably mounted on the winding roll adjacent the outer end of the second push rod and including a transfer pad, the transfer pad assembly being movable between a first position in which the transfer pad is inwardly of the outer surface of the winding roll and a second position in which the transfer pad projects beyond the outer surface of the winding roll and is engageable with a web thereon, the second push rod engaging the transfer pad assembly when the second push rod is in its first position to retain the transfer pad assembly in its first position, the second push rod being movable by the camshaft when the speed of the camshaft changes between said first and second speeds so that the second push rod moves away from its first position and allows the transfer pad assembly to move to its second position.

14. The apparatus of claim 13 in which the transfer pin assembly includes a transfer pin pivot shaft pivotally mounted in the winding roll, the transfer pin being mounted on the transfer pin pivot shaft, the transfer pad assembly including a transfer pad pivot shaft pivotally mounted in the winding roll, the transfer pad being mounted on the transfer pad pivot shaft, a stationary transfer pin cam attached to the frame, a transfer pin cam follower mounted on the transfer pin pivot shaft, the transfer pin cam follower being movable into engagement with the transfer pin cam when the first push rod moves away from its first position, a stationary transfer pad cam attached to the frame, a transfer pad cam follower mounted on the transfer pad pivot shaft, the transfer pad cam follower being movable into engagement with the transfer pad cam when the second push rod moves away from its first position.

15. The apparatus of claim 14 including a journal supporting the winding roll and rotatably mounted on the frame, the stationary transfer pin cam and the stationary transfer pad cam being rotatably mounted on the journal whereby the position of the transfer pin cam relative to and the transfer pin cam follower and the position of the transfer pad cam relative to the transfer pad cam follower is controlled.

16. A web-winding apparatus comprising:

a frame, a journal rotatably mounted on the frame, a winding roll mounted on the journal for rotation therewith, the winding roll having an outer surface for contacting a web, a pivot shaft pivotally mounted in the winding roll adjacent the outer surface thereof, a web-engaging member mounted on the pivot shaft for rotation therewith and being movable between a latched position and an unlatched position, a stationary ring cam rotatably mounted on the journal and attached to the frame, and a cam follower mounted on the pivot shaft, the cam follower engaging the stationary ring cam when the web-engaging member is in its unlatched position.

* * * * *